US009047805B2

(12) United States Patent
Chen et al.

(10) Patent No.: US 9,047,805 B2
(45) Date of Patent: Jun. 2, 2015

(54) DRIVING METHOD OF PIXELS OF DISPLAY PANEL

(71) Applicant: Au Optronics Corporation, Hsinchu (TW)

(72) Inventors: Yung-Jen Chen, Hsinchu County (TW); Hsin-Hsuan Lo, Hsinchu County (TW); Chieh-Teng Chang, Nantou County (TW); Hui-Ling Wang, Miaoli County (TW)

(73) Assignee: Au Optronics Corporation, Hsinchu (TW)

( * ) Notice: Subject to any disclaimer, the term of this patent is extended or adjusted under 35 U.S.C. 154(b) by 302 days.

(21) Appl. No.: 13/711,640

(22) Filed: Dec. 12, 2012

(65) Prior Publication Data

US 2014/0063076 A1 Mar. 6, 2014

(30) Foreign Application Priority Data

Sep. 5, 2012 (TW) ..... 101132324 A

(51) Int. Cl.
*G09G 5/10* (2006.01)

(52) U.S. Cl.
CPC ..... *G09G 5/10* (2013.01)

(58) Field of Classification Search
CPC ..... G09G 5/10; G09G 3/3233; G09G 3/2022; G09G 2320/0233
USPC ..... 345/690
See application file for complete search history.

(56) References Cited

U.S. PATENT DOCUMENTS

| | | | | |
|---|---|---|---|---|
| 6,801,220 | B2 | 10/2004 | Greier et al. | |
| 7,932,915 | B2 * | 4/2011 | Miyata et al. | 345/690 |
| 8,564,518 | B2 | 10/2013 | Nakahata et al. | |
| 2006/0040419 | A1 | 2/2006 | Wu | |
| 2008/0079673 | A1 * | 4/2008 | Liu et al. | 345/87 |
| 2008/0094331 | A1 | 4/2008 | Lin et al. | |
| 2009/0267965 | A1 | 10/2009 | Han | |

(Continued)

FOREIGN PATENT DOCUMENTS

| | | |
|---|---|---|
| CN | 1945672 | 4/2007 |
| CN | 101140749 | 3/2008 |

(Continued)

OTHER PUBLICATIONS

"Office Action of China Counterpart Application", issued on May 5, 2014, p. 1-p. 7.

*Primary Examiner* — Lixi C Simpson
(74) *Attorney, Agent, or Firm* — Jianq Chyun IP Office

(57) ABSTRACT

A driving method of pixels of a display panel is provided, which is adapted to drive a pixel of the display panel corresponding to a target grey-level of a display frame. In this method, a first pixel voltage is applied to the pixel during a first display period. At least one second pixel voltage is applied to the pixel during a second display period. The first and second display periods correspond to the display frame, and an enabling duration of the second display period is longer than the enabling duration of the first display period. When the target grey-level is not equal to a limit grey-level, the grey-level corresponding to the pixel voltage is different from the grey-level corresponding to the second pixel voltages. A sum of optical effects of the pixel during the first and second display periods is equal to the optical effect of the target grey-level.

14 Claims, 9 Drawing Sheets

(56) References Cited

U.S. PATENT DOCUMENTS

| | | | | |
|---|---|---|---|---|
| 2011/0096058 | A1 | 4/2011 | Nakahata et al. | |
| 2013/0141424 | A1 * | 6/2013 | Chang et al. | 345/419 |

FOREIGN PATENT DOCUMENTS

| | | |
|---|---|---|
| CN | 102138098 | 7/2011 |
| TW | 201005721 | 2/2010 |

* cited by examiner

DRIVING METHOD OF PIXELS OF DISPLAY PANEL

CROSS-REFERENCE TO RELATED APPLICATION

This application claims the priority benefit of Taiwan application serial no. 101132324, filed on Sep. 5, 2012. The entirety of the above-mentioned patent application is hereby incorporated by reference herein and made a part of this specification.

BACKGROUND OF THE DISCLOSURE

1. Field

The present disclosure relates to a driving method of pixels of a display panel, and more particularly, to a driving method of pixels of a liquid crystal display panel.

2. Description of Related Art

Following the trend of ever-larger size of liquid crystal displays, the wide view angle technology of the liquid crystal display panels must be continuously advanced in order to address the view angle issue of large-sized displays. Multi-domain vertical alignment (MVA) liquid crystal display panel is currently a common wide view angle technology.

The liquid crystal display panels utilize the design of alignment pattern such that liquid crystal molecules within the same pixel region are divided into multiple alignment domains to achieve the wide view angles, which are referred to as MVA liquid crystal displays. Due to the optical characteristics of the liquid crystal molecures, this type of liquid crystal display panels may generate a color washout phenomenon at different view angles. In order to reduce the color washout, perfection of the driving principle and pixel design are usually employed to form display areas with different brightness within a single pixel region and form multiple alignment domains within the various display areas with different brightness. However, forming the display areas with different brightness within a single pixel region affects an aperture ratio of the pixel, thus affecting the displaying result of the liquid crystal display panel.

SUMMARY OF THE DISCLOSURE

Accordingly, the present disclosure is directed to a driving method of pixels of a display panel, which enables a single pixel to sequentially display different brightness during the time period of a same display frame, thereby improving the color washout phenomenon without sacrificing the aperture ratio of the pixel.

The present disclosure provides a pixel driving method of pixels of a display panel, adapted to drive a first pixel of the display panel corresponding to a target grey-level of a display frame. The pixel driving method includes the following steps. A first pixel voltage is applied to the first pixel during a first display period. At least one second pixel voltage is applied to the first pixel during a second display period. The first display period and the second display period correspond to the display frame, and an enabling duration of the second display period is longer than the enabling duration of the first display period. When the target grey-level is not equal to a limit grey-level, the grey-level corresponding to the first pixel voltage is different from the grey-levels corresponding to the second pixel voltages. A sum of optical effects the first pixel provides during the first display period and during the second display period is equal to the optical effect of the target grey-level.

In one embodiment, the first display period is prior to the second display period.

In one embodiment, the first display period comprises a first enabling period, the first pixel voltage is applied to the first pixel during the first enabling period, the second display period comprises at least one second enabling period, and the second pixel voltages are respectively applied to the first pixel during the second enabling periods.

In one embodiment, the first enabling period and the second enabling periods are equal to each other.

In one embodiment, when the target grey-level is equal to a limit grey-level, the grey-levels corresponding to the first pixel voltage and the second pixel voltages are set to be equal to the target grey-level.

In one embodiment, the pixel driving method is further adapted to drive multiple second pixels of the display panel corresponding to the target grey-level of the display frame. The pixel driving method further includes the following steps. The first pixel voltage is applied to the second pixels during multiple third display periods, respectively. At least one second pixel voltage is applied to the second pixels during multiple fourth display periods. The third display periods and the fourth display periods correspond to the display frame, the enabling duration of each of the fourth display periods is longer than the enabling duration of a corresponding one of the third display periods, a sum of the optical effects of each of the second pixels during the corresponding third display period and the corresponding fourth display period is equal to the optical effect of the target grey-level, and the first display period and the third display periods do not overlap.

In one embodiment, the first display period and the third display periods are alternately arranged.

In one embodiment, each of the third display periods is prior to a corresponding one of the fourth display periods.

In one embodiment, each of the third display periods comprises a first enabling period, the first pixel voltage is applied to a corresponding one of the second pixels during the first enabling period, each of the fourth display period comprises at least one second enabling period, and the second pixel voltages are respectively applied to a corresponding one of the second pixels during the second enabling periods.

In one embodiment, the grey-levels corresponding to the second pixel voltages are different from each other.

In one embodiment, the grey-levels corresponding to the second pixel voltages are arranged in an order from high to low according to a time sequence.

In one embodiment, the grey-levels corresponding to the second pixel voltages are equal to each other.

In one embodiment, the grey-level corresponding to first pixel voltage is larger than the grey-levels corresponding to the second pixel voltages.

In one embodiment, the grey-level corresponding to the first pixel voltage is larger than the target grey-level, and the grey-levels corresponding to the second pixel voltages are less than the target grey-level.

In view of the foregoing, in the driving method of the pixels of the display panel of embodiments of the present disclosure, when the target grey-level of the display frame is not equal to the limit grey-level, the grey-level that the first pixel voltage applied to the pixel during the first display period corresponds to is set to be different from the grey-level that the second pixel voltage applied to the pixel during the second display period corresponds to, and the sum of the optical effects the pixel provides during the first display period and during the second display period is equal to the optical effect of the target grey-level. As such, there is a difference between the optical effects the pixel provides during the first display period and during the second display period, thereby improving the color washout phenomenon without sacrificing the aperture ratio of the pixel.

Other objectives, features and advantages of the present disclosure will be further understood from the further technological features disclosed by the embodiments of the present disclosure wherein there are shown and described preferred embodiments of this disclosure, simply by way of illustration of modes best suited to carry out the disclosure.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF THE EMBODIMENTS

Figure 1:
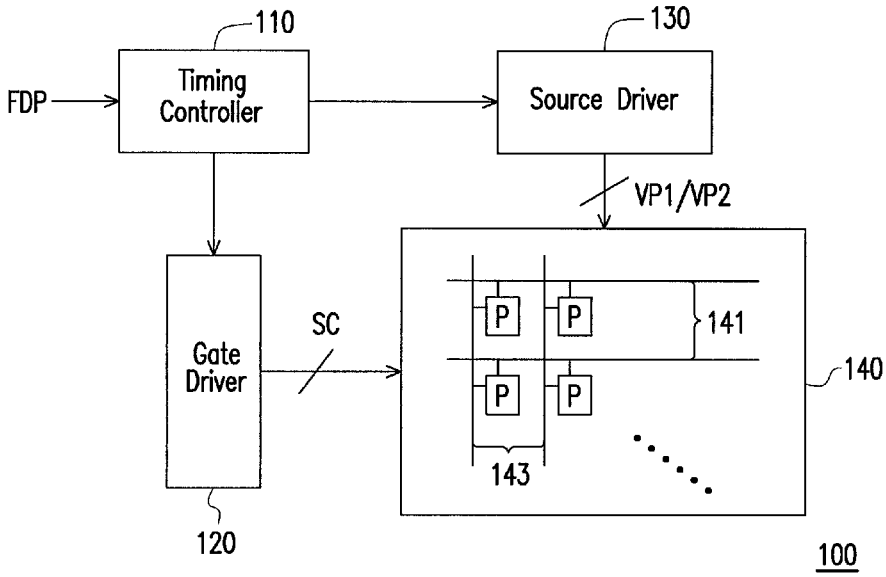
FIG. 1 illustrates a display apparatus according to one embodiment of the present disclosure.

FIG. 1 illustrates a display apparatus according to one embodiment of the present disclosure. Referring to FIG. 1, in the present embodiment, the display apparatus 100 includes a timing controller 110, a gate driver 120, a source driver 130, and a display panel 140. The timing controller 110 receives a display frame FDP. The gate driver 120 is coupled to the timing controller 110 and provides multiple scan signals SC to the display panel 140 under the control of the timing controller 110. The source driver 130 is coupled to the timing controller 110 and sequentially provides multiple first pixel voltages VP1 and multiple second pixel voltages VP2 corresponding to the display frame FDP under the control of the timing controller 110.

The display panel 140 includes multiple pixels P, multiple scan lines 141 and multiple data lines 143. Each pixel P is connected to a corresponding one of the scan lines 141 so as to receive a corresponding scan signal SC through the corresponding scan line 141 and turn on under the control of the corresponding scan signal SC. Each pixel P is coupled to a corresponding one of the data lines 143. The turned on pixels P receive the respective first pixel voltages VP1 through the respective data lines 143 during a first display period DP1, and the turned on pixels P receive the respective second pixel voltages VP2 through the respective data lines 143 during a second display period DP2.

In the present embodiment, the first display period DP1 and the second display period DP2 correspond to the same display frame FDP, each pixel P displays a target grey-level TGL corresponding to the same display image FDP under the control of the corresponding first pixel voltage VP1 and the corresponding second pixel voltage VP2, and the sum of optical effects each pixel P provides according to the corresponding first pixel voltage VP1 and the corresponding second pixel voltage VP2 (i.e. during the first display period DP1 and during the second display period DP2) is equal to the optical effect of the target grey-level TGL. As such, the display panel 140 can display an image corresponding to the display frame.

In the present embodiment, when the target grey-level TGL is not equal to a limit grey-level, the grey-level corresponding to the first pixel voltage VP1 may be set to be different from the grey-level corresponding to the second pixel voltage VP2. Therefore, the optical effect which each pixel P provides when receiving the corresponding first pixel voltage VP1 is different from the optical effect which the same pixel P provides when receiving the corresponding second pixel voltage VP2, and the optical effect which each pixel P provides usually varies between the optical effect corresponding to the first pixel voltage VP1 and the optical effect corresponding to the second pixel voltage VP2. Therefore, each pixel P can sequentially display different brightness within the time corresponding to the display frame. As such, there is no need to sacrifice the pixel aperture ratio and the color washout phenomenon is improved.

On the other hand, when the target grey-level TGL is equal to the grey-level limit, the grey-levels corresponding to the first pixel voltage VP1 and the second pixel voltage VP2 may be set to the limit grey-level. The limit grey-level may be a maximum grey-level or a minimum grey-level. The maximum grey-level may be a single grey-level (e.g. grey-level 255) or a range of grey-levels (e.g. grey-level 224 to 255), and the minimum grey-level may be a single grey-level (e.g. grey-level 0) or a range of grey-levels (e.g. 0 to 31).

Figure 2:
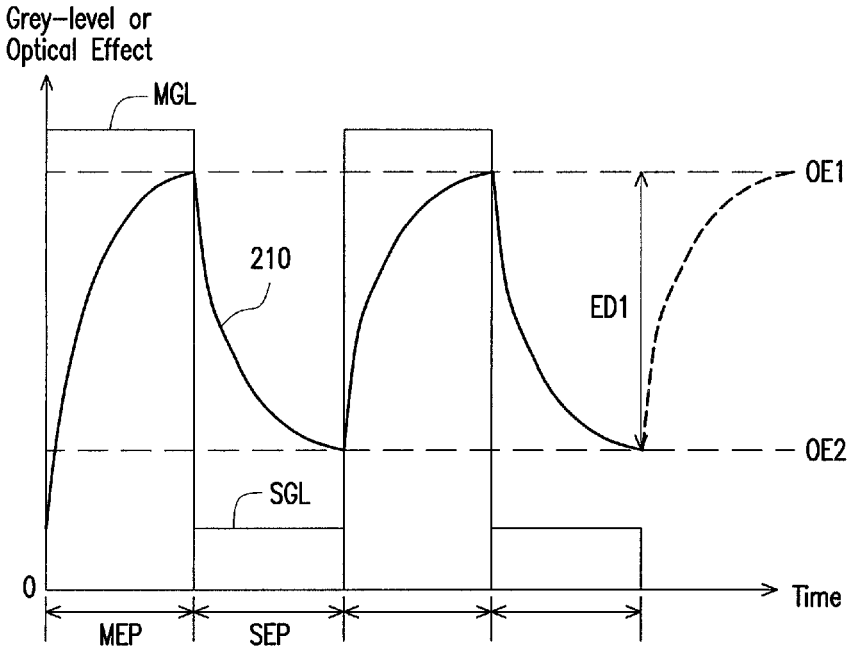
FIG. 2 illustrates the pixel optical effect and pixel voltage of the display apparatus of FIG. 1 according to one embodiment of the present disclosure.

FIG. 2 illustrates the pixel optical effect and pixel voltage of the display apparatus of FIG. 1 according to one embodiment of the present disclosure. Referring to FIG. 1 and FIG. 2, in the present embodiment, the display panel 140 displays one display frame FDP during two enabling periods MEP (corresponding to a first enabling period) and SEP (corresponding to the second enabling period). Enabling durations of the enabling periods MEP and SEP are equal to each other, i.e. the field rate of the display apparatus 100 is kept constant. However, this should not be regarded as limiting.

During the enabling period MEP, the source driver 130 is controlled by the timing controller 110 to apply a first pixel voltage VP1 to the turned on pixel P. The first pixel voltage VP1 is set to correspond to grey-level MGL, and the optical effect of the pixel P is increased to OE1 (with reference to curve 210). The grey-level MGL is set to be larger than the target grey-level TGL. During the enabling period SEP, the source driver 130 is controlled by the timing controller 110 to apply the second pixel voltage VP2 to the turned on pixel P. The second pixel voltage VP2 is set to correspond to grey-level SGL, and the optical effect of the pixel P is reduced to OE2. The grey-level SGL is set to be less than the target grey-level TGL. As such, the optical effect of the pixel P changes from OE1 to OE2 to achieve an optical effect difference ED1, such that each pixel P can display different brightness (i.e. different optical effect) during the enabling period SEP to reduce the color washout. In other words, the color washout is reduced by taking advantage of time, without sacrificing the aperture ratio of the pixel.

According to the above description, the enabling period MEP corresponds to the first display period DP1, the enabling period SEP corresponds to the second display period DP2, and the enabling period MEP is prior to the enabling period SEP. In other words, in the present embodiment, the first display period DP1 includes the enabling period MEP, the second display period DP2 includes the enabling period SEP, and the first display period DP1 is prior to the second display period DP2. However, this should not be regarded as limiting. Because the enabling durations of the enabling periods MEP and SEP are the same, the enabling durations of the first display period DP1 and the second display period DP2 are equal to each other.

Figure 3A:
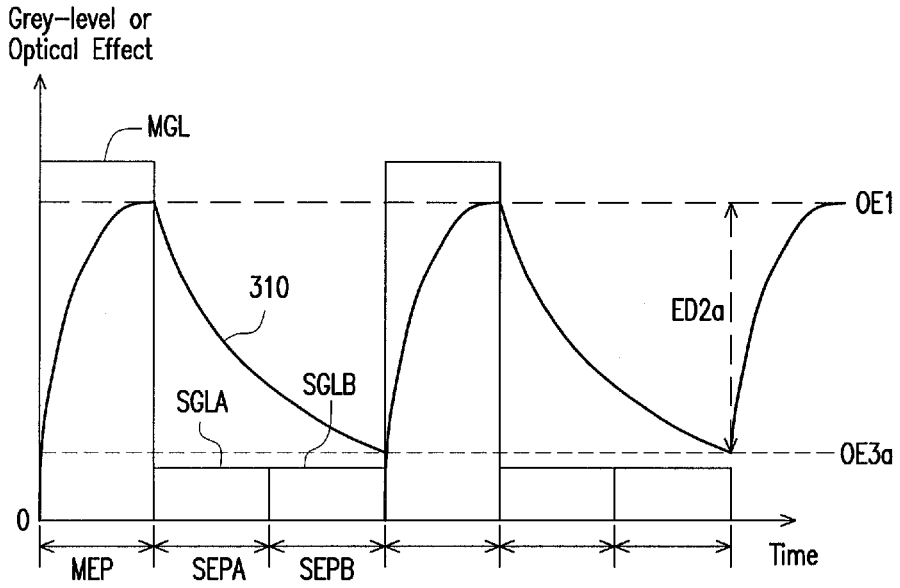
FIG. 3A and FIG. 3B each illustrates the pixel optical effect and pixel voltage of the display apparatus of FIG. 1 according to one embodiment of the present disclosure.

FIG. 3A illustrates the pixel optical effect and pixel voltage of the display apparatus of FIG. 1 according to one embodiment of the present disclosure. Referring to FIG. 1 and FIG. 3A, in the present embodiment, the display panel 140 displays one display frame FDP during three enabling periods MEP (corresponding to the first enabling period), SEPA and SEPB (corresponding to the second enabling period). Enabling durations of the enabling periods MEP, SEPA and SEPB are equal to each other, i.e. the field rate of the display apparatus 100 is kept constant. However, this should not be regarded as limiting.

During the enabling period MEP, the source driver 130 likewise is controlled by the timing controller 110 to apply a first pixel voltage VP1 corresponding to the grey-level MGL to the turned on pixel P, such that the optical effect of the pixel P is increased to OE1 (with reference to curve 310). The grey-level MGL is set to be larger than the target grey-level TGL. During the enabling periods SEPA and SEPB, the source driver 130 is controlled by the timing controller 110 to apply multiple second pixel voltages VP2 to the turned on pixel P. The second pixel voltages VP2 are set to correspond to grey-level SGLA and grey-level SGLB, respectively, and the optical effect of the pixel P is reduced to OE3*a*. The grey-level SGLA and grey-level SGLB are set to be less than the target grey-level TGL, and the grey-level SGLA and grey-level SGLB are set to be equal to each other. As such, the optical effect of the pixel P changes from OE1 to OE3*a* to achieve an optical effect difference ED2*a*, such that each pixel P can display different brightness (i.e. different optical effect) during the enabling period to reduce the color washout. In addition, under the condition that the grey-level SGLB and the grey-level SGL are approximately the same, the optical effect difference ED2*a* is larger than the optical effect difference ED1 of the embodiment of FIG. 2. Therefore, the color washout reduction result of the present embodiment is better than that of the embodiment of FIG. 2.

According to the above description, the enabling period MEP corresponds to the first display period DP1, the enabling periods SEPA and SEPB correspond to the second display period DP2, and the enabling period MEP is prior to the enabling periods SEPA and SEPB. In other words, in the present embodiment, the first display period DP1 includes the enabling period MEP, the second display period DP2 includes the enabling periods SEPA and SEPB, and the first display period DP1 is prior to the second display period DP2. However, this should not be regarded as limiting. Because the enabling durations of the enabling periods MEP, SEPA and SEPB are equal to each other, the enabling duration of the first display period DP1 is less than the enable duration of the second display period DP2.

Figure 3B:
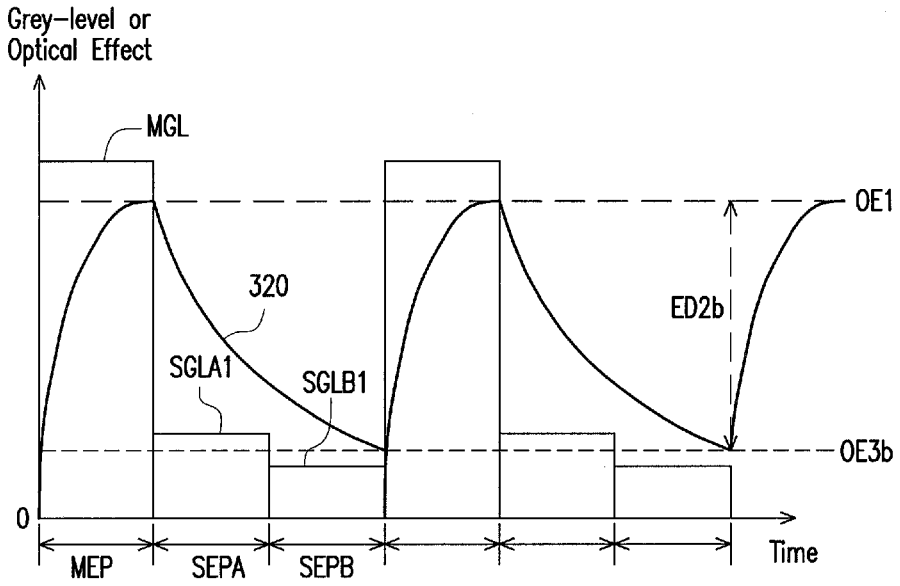

FIG. 3B illustrates the pixel optical effect and pixel voltage of the display apparatus of FIG. 1 according to one embodiment of the present disclosure. Referring to FIG. 1, FIG. 3A and FIG. 3B, in the present embodiment, the difference lies in the grey-level SGLA1 and grey-level SGLA2 that the second pixel voltages VP2 correspond to during the enabling periods SEPA and SEPB. In the present embodiment, the grey-level SGLA1 and the grey-level SGLA2 are different and are arranged in an order from high to low according to the time sequence (i.e. decrease according to the time sequence). In addition, under the condition that the grey-level SGLB and the grey-level SGLB1 are approximately the same, the optical effect difference ED2*b* (with reference to curve 320) of the pixel P is the same as the optical effect difference ED2*a*. The difference between the grey-level SEPA and the grey-level SEPB (i.e. the decreasing amplitude) may be determined depending upon actual requirements and is not intended to be limited to any particular value as illustrated herein.

Figure 4A:
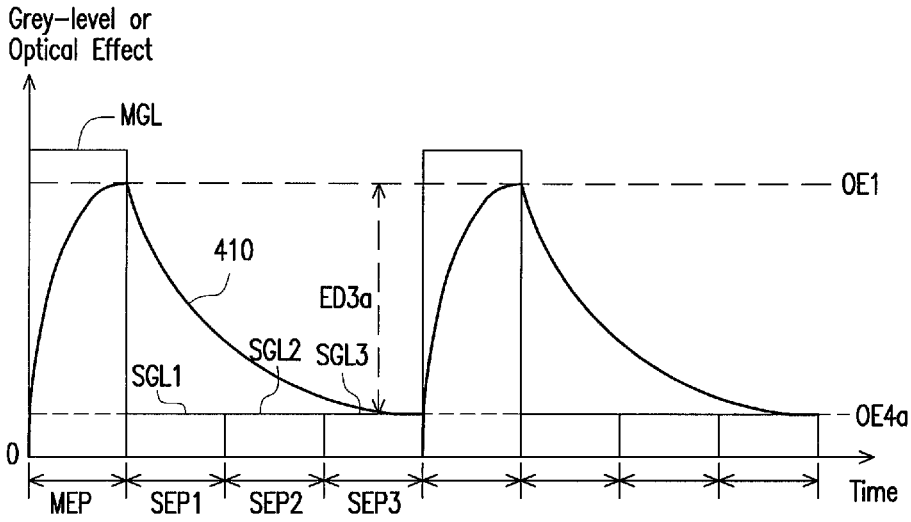
FIG. 4A and FIG. 4B each illustrates the pixel voltage and pixel optical effect of the display apparatus of FIG. 1 according to one embodiment of the present disclosure.

FIG. 4A illustrates the pixel voltage and pixel optical effect of the display apparatus of FIG. 1 according to one embodiment of the present disclosure. Referring to FIG. 1 and FIG. 4A, in the present embodiment, the display panel 140 displays one display frame FDP during four enabling periods MEP (corresponding to the first enabling period) and SEP1 to SEP3 (corresponding to the second enabling period). Enabling durations of the enabling periods MEP and SEP1 to SEP3 are equal to each other, i.e. the field rate of the display apparatus 100 is kept constant. However, this should not be regarded as limiting.

During the enabling period MEP, the source driver 130 likewise is controlled by the timing controller 110 to apply a first pixel voltage VP1 corresponding to the grey-level MGL to the pixel P that is turned on, such that the optical effect of the pixel P is increased to OE1 (with reference to curve 410). The grey-level MGL is set to be larger than the target grey-level TGL. During the enabling periods SEP1 to SEP3, the source driver 130 is controlled by the timing controller 110 to apply multiple second pixel voltages VP2 to the pixel P that is turned on. The second pixel voltages VP2 are set to correspond to grey-levels SGL1 to SGL3, respectively, and the optical effect of the pixel P is reduced to OE4*a*. The grey-levels SGL1 to SGL3 are set to be less than the target grey-level TGL, and the grey-levels SGL1 to SGL3 are set to be equal to each other. As such, the optical effect of the pixel P changes from OE1 to OE4*a* to achieve an optical effect difference ED3*a*, such that each pixel P can display different brightness (i.e. different optical effect) during the enabling periods SEP1 to SEP3 to reduce the color washout. In addition, under the condition that the grey-levels SGL3, SGLB and SGL are approximately the same, the optical effect difference ED3*a* is larger than the optical effect difference ED1, ED2*a* and ED2*b* of the embodiment of FIG. 2, FIG. 3A and FIG. 3B. Therefore, the color washout reduction result of the present embodiment is better than that of the embodiment of FIG. 2, FIG. 3A and FIG. 3B.

According to the above description, the enabling period MEP corresponds to the first display period DP1, the enabling periods SEP1 to SEP3 correspond to the second display period DP2, and the enabling period MEP is prior to the enabling periods SEP1 to SEP3. In other words, in the present embodiment, the first display period DP1 includes the enabling period MEP, the second display period DP2 includes the enabling periods SEP1 to SEP3, and the first display period DP1 is prior to the second display period DP2. However, this should not be regarded as limiting. Because the enabling durations of the enabling periods MEP and SEP1 to SEP3 are equal to each other, the enabling duration of the first display period DP1 is less than the enable duration of the second display period DP2.

Figure 4B:
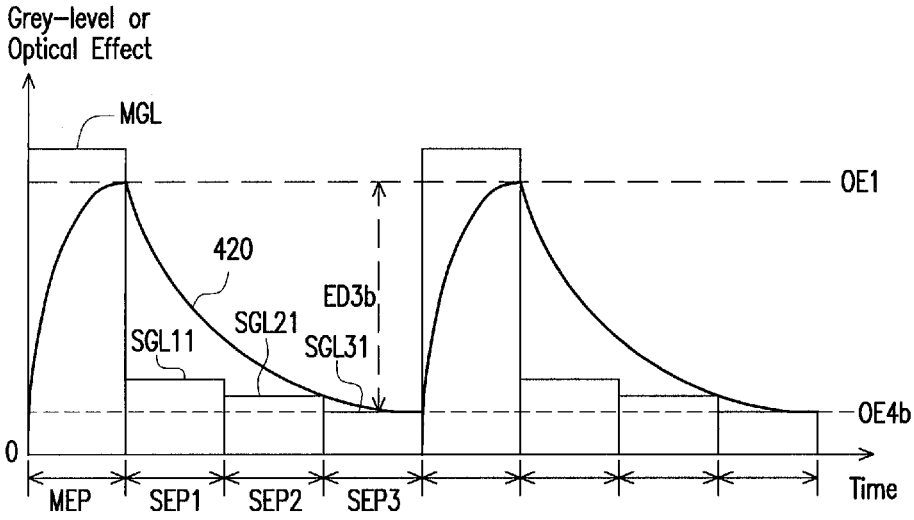

FIG. 4B illustrates the pixel voltage and pixel optical effect of the display apparatus of FIG. 1 according to one embodiment of the present disclosure. Referring to FIG. 1, FIG. 4A and FIG. 4B, in the present embodiment, the difference lies in the grey-levels SGL11 to SGL31 that the second pixel voltages VP2 correspond to during the enabling periods SEP1 to SEP3. In the present embodiment, the grey-levels SGL11 to SGL31 are different and are arranged in an order from high to low according to the time sequence (i.e. decrease according to the time sequence). In addition, under the condition that the grey-level SGL3 and the grey-level SGL31 are approximately the same, the optical effect difference ED3*b* (with reference to curve 420) of the pixel P is the same as the optical effect difference ED3*a*. The difference between the grey-levels SEP1 to SEP3 (i.e. the decreasing amplitude) may be determined depending upon actual requirements and is not intended to be limited to any particular value as illustrated herein.

As described in the embodiments of FIG. 2, FIG. 3A, FIG. 3B, FIG. 4A and FIG. 4B, the number of the enabling periods of the second display period DP2 of the embodiments of the present disclosure may be determined based on the field rate of the display apparatus and other actual requirements and thus is not intended to be limited to any particular values illustrated herein.

Figure 5:
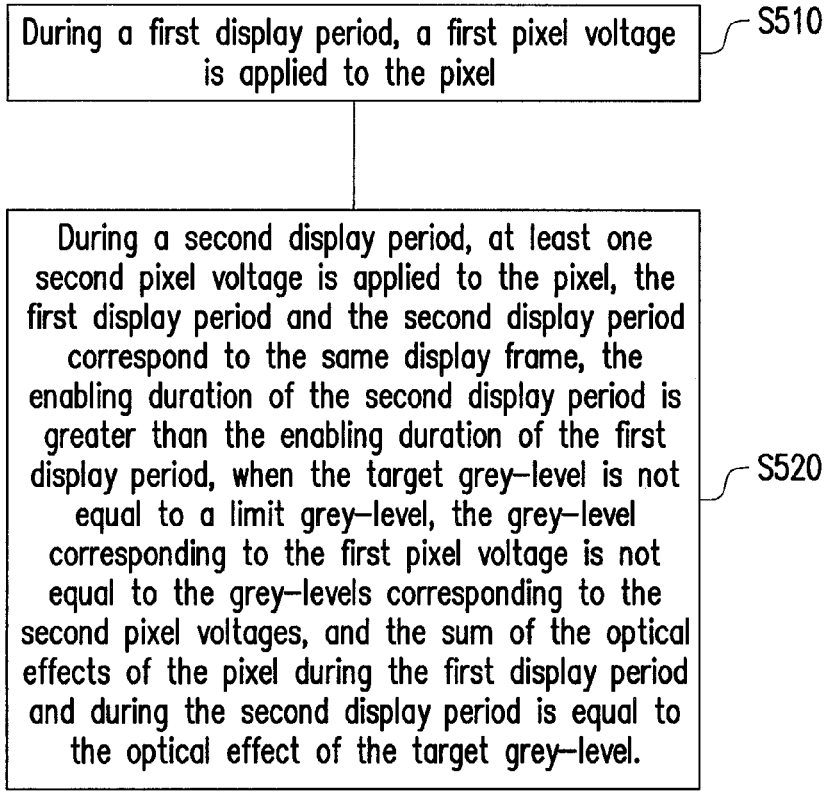
FIG. 5 illustrates a flow chart of a driving method of a pixel of a display panel according to one embodiment of the present disclosure.

FIG. 5 illustrates a flow chart of a pixel driving method for a display panel according to one embodiment of the present disclosure. Referring to FIG. 5, in the present embodiment, the driving method of pixels of a display panel is adapted to drive a pixel of the display panel according to a target grey-level of a display frame. The driving method includes the following steps. During a first display period, a first pixel voltage is applied to the pixel (step S510). During a second display period, at least one second pixel voltage is applied to the pixel (step S520), wherein the first display period and the second display period correspond to the same display frame, and the enabling duration of the second display period is longer than the enabling duration of the first display period. Moreover, when the target grey-level is not equal to a limit grey-level, the grey-level corresponding to the first pixel voltage is not equal to the grey-levels corresponding to the second pixel voltages, and the sum of the optical effects of the pixel during the first display period and during the second display period is equal to the optical effect of the target grey-level. The order of the above steps is described for the purposes of illustration only and should not be regarded as limiting. In addition, for details of the above steps, the description of the embodiments of FIG. 1, FIG. 2, FIG. 3A, FIG. 3B, FIG. 4A and FIG. 4B may be referred to, and explanation thereof is not repeated herein.

In addition, in the embodiments of FIG. 2, FIG. 3A, FIG. 3B, FIG. 4A and FIG. 4B, all the pixels P are driven in the same time sequence. As a result, all the pixels P have the same pixel lighting time period (i.e. the enabling period MEP in which the first pixel voltage VP1 corresponding to the grey-level MGL is applied to the turned on pixel P), thereby causing the frame flicker phenomenon. Therefore, the embodiments below provide flicker compensation to reduce the feeling of frame flicker.

Figure 6A:
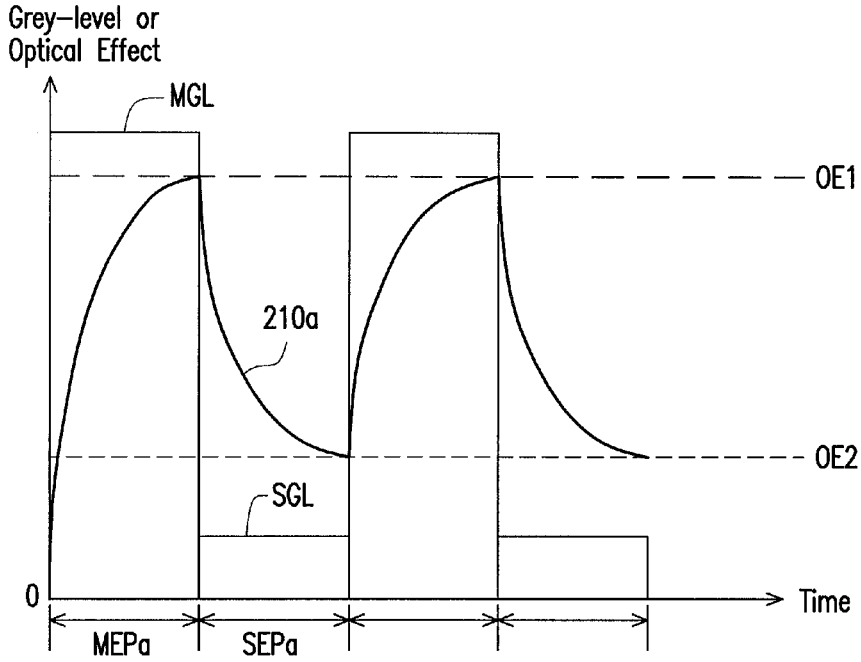
FIG. 6A and FIG. 6B illustrate the pixel voltage and pixel optical effect of the display apparatus of FIG. 1 according to one embodiment of the present disclosure.
Figure 6B:
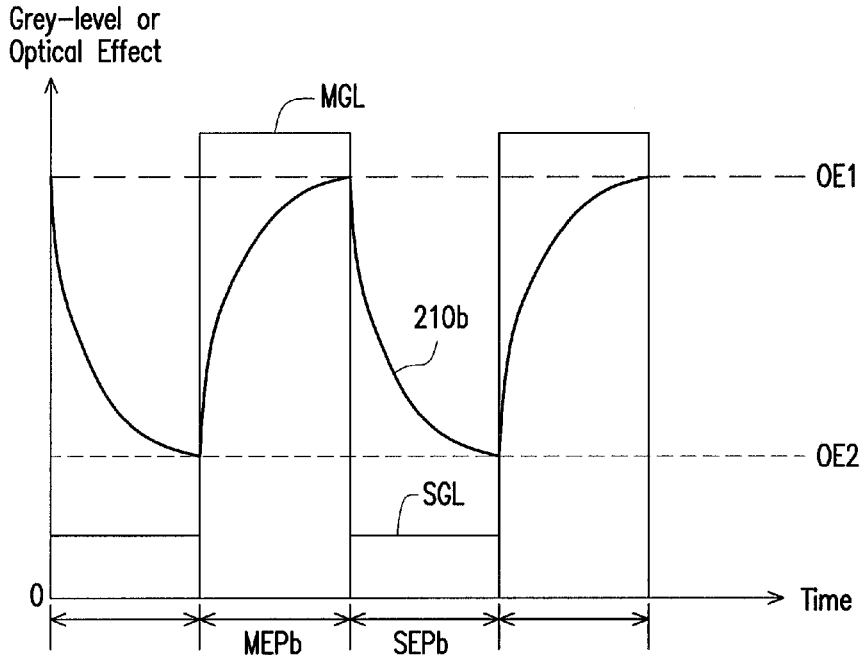

FIG. 6A and FIG. 6B illustrate the pixel voltage and pixel optical effect of the display apparatus of FIG. 1 according to one embodiment of the present disclosure. Referring to FIG. 1, FIG. 6A and FIG. 6B, in the present embodiment, it is assumed that the display panel 140 displays a display frame FDP during two enabling periods (e.g. MEPa and SEPa, or MEPb and SEPb). Therefore, the pixels P of the display panel 140 are divided into two parts. For example, the pixels P in odd rows are set to be the first part (corresponding to the first pixels), and the pixels P in even rows are set to be the other part (corresponding to the second pixels). Alternatively, the pixels P in odd column are set to be the first part (corresponding to the first pixels), while the pixels P in even column are set to be the other part (corresponding to the second pixels).

In the present embodiment, the part of the pixels P in the odd rows or columns are driven in the driving sequence as shown in FIG. 6A, and the part of the pixels P in the even rows or columns are driven in the driving sequence as shown in FIG. 6B. The embodiment of FIG. 2 may be referred to for an understanding of the driving sequence shown in FIG. 6A and FIG. 6B, where the same or similar parts are denoted by the same or similar reference numerals and explanation thereof is not repeated herein. The enabling period MEPa (corresponding to the first display period) in which the first pixel voltage VP1 corresponding to the grey-level MGL is applied to the turned on pixel P as shown in FIG. 6A and the enabling period MEPb (corresponding to the third display period) in which the first pixel voltage VP1 corresponding to the grey-level MGL is applied to the turned on pixel P as shown in FIG. 6B are alternately arranged with each other, such that the lighting time of the pixels in the odd rows or odd columns is different from the lighting time of the pixels in the even rows or even columns. For example, the time points at which curves 210*a* and curve 210*b* reach the optical effect OE1 are alternately arranged with each other. During the enabling period SEPa (corresponding to the second display period) and SEPb (corresponding to the fourth display period), the second pixel voltage VP2 corresponding to the grey-level SGL is applied to the turned on pixel P. Therefore, the present embodiment reduces the feeling of frame flicker while improving the color washout phenomenon.

Figure 7A:
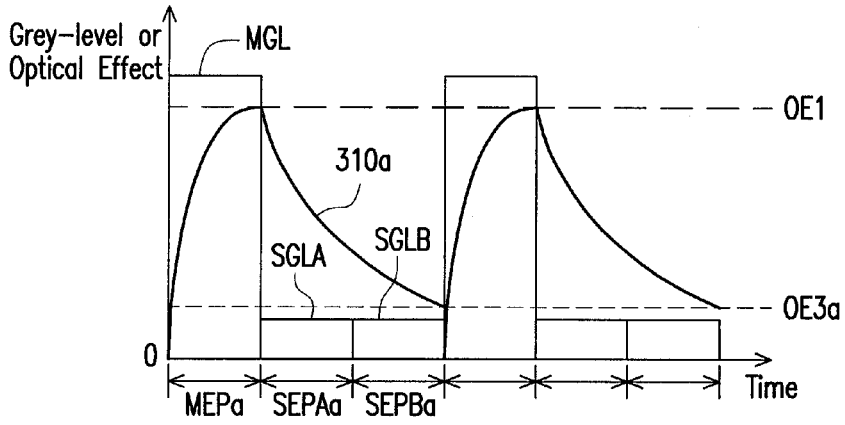
FIG. 7A to FIG. 7C each illustrate the pixel voltage and pixel optical effect of the display apparatus of FIG. 1 according to one embodiment of the present disclosure.
Figure 7B:
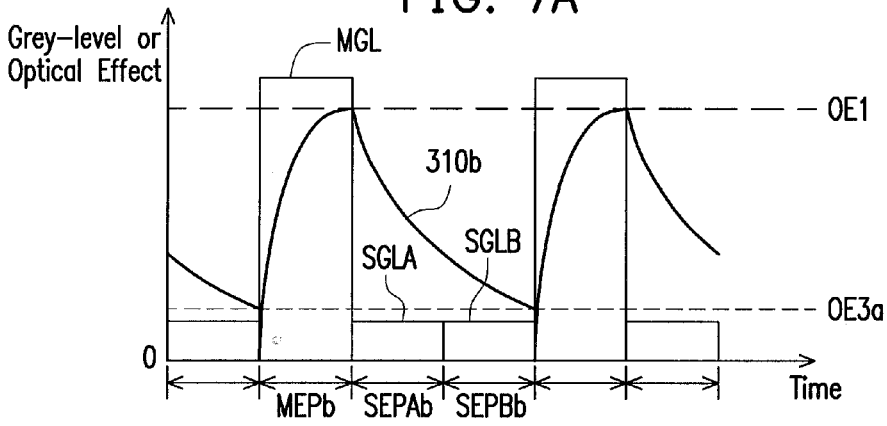
Figure 7C:
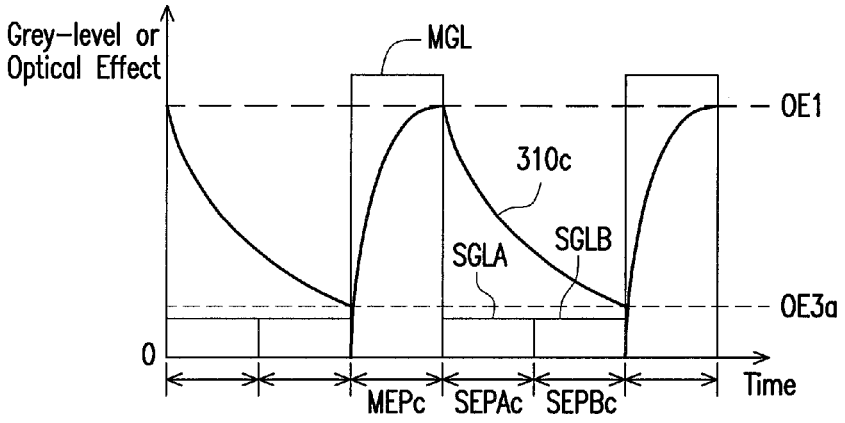

FIG. 7A to FIG. 7C each illustrate the pixel voltage and pixel optical effect of the display apparatus of FIG. 1 according to one embodiment of the present disclosure. Referring to FIG. 1, FIG. 7A to FIG. 7C, in the present embodiment, it is assumed that the display panel 140 displays a display frame FDP during three enabling periods (e.g. MEPa, SEPAa and SEPBa; MEPb, SEPAb and SEPBb; MEPc, SEPAc and SEPBc). Therefore, the pixels P of the display panel 140 are divided into three parts. For example, the pixels P in the (3i+1)-th rows are set to be the first part (corresponding to the first pixels), the pixels P in the (3i+2)-th rows are set to be the second part (corresponding to the second pixels), and the pixels P in the (3i+3)-th rows are set to be the third part (corresponding to the second pixels). Alternatively, the pixels P in the (3i+1)-th columns are set to be the first part (corresponding to the first pixels), the pixels P in the (3i+2)-th columns are set to be the second part (corresponding to the second pixels), and the pixels P in the (3i+3)-th columns are set to be the third part (corresponding to the second pixels). The value i is a positive integer longer than zero or equal to zero.

In the present embodiment, the part of the pixels P in the (3i+1)-th rows or columns are driven in the driving sequence as shown in FIG. 7A, the part of the pixels P in the (3i+2)-th rows or columns are driven in the driving sequence as shown in FIG. 7B, and the part of the pixels P in the (3i+3)-th rows or columns are driven in the driving sequence as shown in FIG. 7C. The embodiment of FIG. 3A may be referred to for an understanding of the driving sequence shown in FIG. 7A, FIG. 7B, and FIG. 7C, where the same or similar parts are denoted by the same or similar reference numerals and explanation thereof is not repeated herein. Alternatively, the driving sequence shown in FIG. 7A, FIG. 7B and FIG. 7C may also be implemented with reference to the embodiment of FIG. 3B.

The enabling period MEPa (corresponding to the first display period) in which the first pixel voltage VP1 corresponding to the grey-level MGL is applied to the turned on pixel P as shown in FIG. 7A, the enabling period MEPb (corresponding to the third display period) in which the first pixel voltage VP1 corresponding to the grey-level MGL is applied to the turned on pixel P as shown in FIG. 7B, and the enabling period MEPc (corresponding to the third display period) in which the first pixel voltage VP1 corresponding to the grey-level MGL is applied to the turned on pixel P as shown in FIG. 7C are alternately arranged with each other, such that the lighting time periods of the pixels in the (3i+1)-th, (3i+2)-th and (3i+3)-th rows are arranged alternately with each other, or the lighting time periods of the pixels in the (3i+1)-th, (3i+2)-th and (3i+3)-th columns are arranged alternately with each other. For example, the time points at which curves 310*a*, 310*b* and 310*c* reach the optical effect OE1 are alternately arranged with each other. During the enabling periods SEPAa, SEPBa (corresponding to the second display period), SEPAb, SEPBb, SEPAc and SEPBc (corresponding to the fourth display period), the second pixel voltage VP2 corresponding to the grey-level SGLA or SGLB is applied to the turned on pixel P. Therefore, the present embodiment reduces the feeling of frame flicker while improving the color washout phenomenon.

Figure 8A:
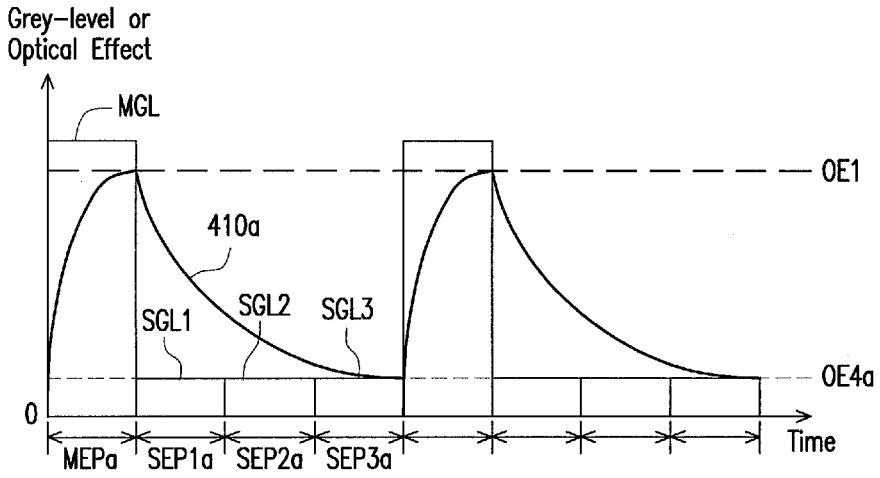
FIG. 8A to FIG. 8D each illustrate the pixel voltage and pixel optical effect of the display apparatus of FIG. 1 according to one embodiment of the present disclosure.
Figure 8B:
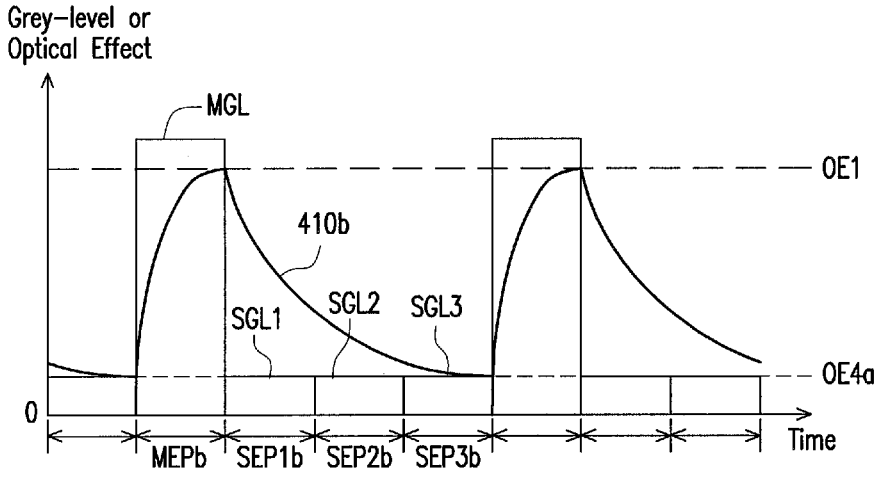

FIG. 8A to FIG. 8D each illustrate the pixel voltage and pixel optical effect of the display apparatus of FIG. 1 according to one embodiment of the present disclosure. Referring to FIG. 1, FIG. 8A to FIG. 8B, in the present embodiment, it is assumed that the display panel 140 displays a display frame FDP during four enabling periods (e.g. MEPa, SEP1*a*, SEP2*a* and SEP3*a*; MEPb, SEP1*b*, SEP2*b* and SEP3*b*; MEPc, SEP1*c*, SEP2*c* and SEP3*c*; MEPd, SEP1*d*, SEP2*d* and SEP3*d*). Therefore, the pixels P of the display panel 140 are divided into four parts. For example, the pixels P in the (4n+1)-th rows are set to be the first part (corresponding to the first pixels), the pixels P in the (4n+2)-th rows are set to be the second part (corresponding to the second pixels), the pixels P in the (4i+3)-th rows are set to be the third part (corresponding to the second pixels), and the pixels P in the (4i+4)-th rows are set to be the fourth part (corresponding to the second pixels). Alternatively, the pixels P in the (4n+1)-th columns are set to be the first part (corresponding to the first pixels), the pixels P in the (4n+2)-th columns are set to be the second part (corresponding to the second pixels), the pixels P in the (4i+3)-th columns are set to be the third part (corresponding to the second pixels), and the pixels P in the (4i+4)-th columns are set to be the fourth part (corresponding to the second pixels). The value n is a positive integer longer than zero or equal to zero.

Figure 8C:
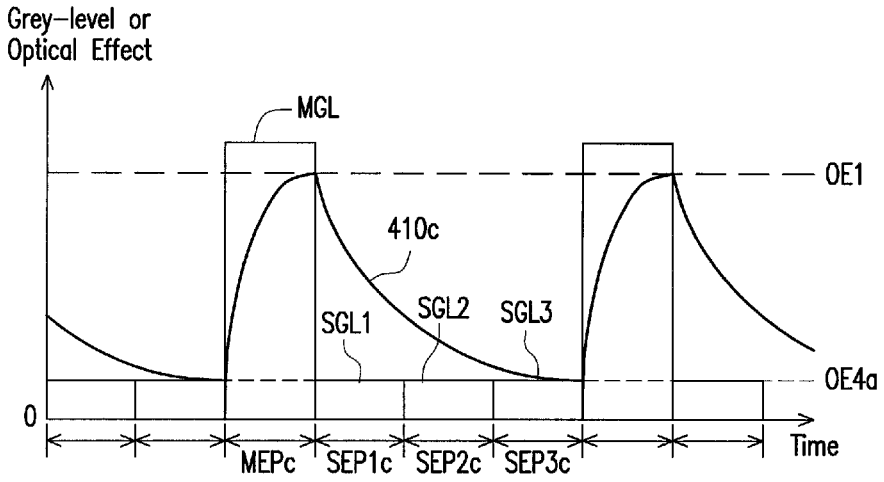
Figure 8D:
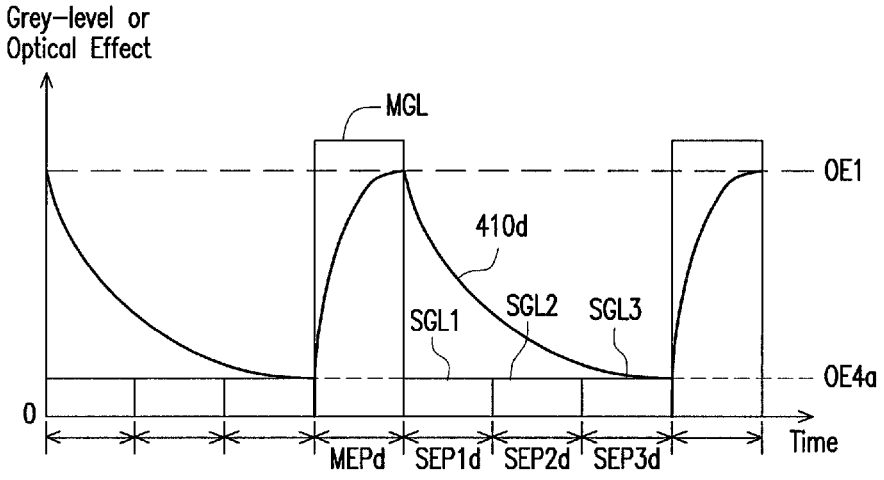

In the present embodiment, the part of the pixels P in the (4n+1)-th rows or columns are driven in the driving sequence as shown in FIG. 8A, the part of the pixels P in the (4n+2)-th rows or columns are driven in the driving sequence as shown in FIG. 8B, the part of the pixels P in the (4n+3)-th rows or columns are driven in the driving sequence as shown in FIG. 8C, and the part of the pixels P in the (4n+4)-th rows or columns are driven in the driving sequence as shown in FIG. 8D. The embodiment of FIG. 4A may be referred to for an understanding of the driving sequence shown in FIG. 8A, FIG. 8B, and FIG. 8C, where the same or similar parts are denoted by the same or similar reference numerals and explanation thereof is not repeated herein. Alternatively, the driving sequence shown in FIG. 8A, FIG. 8B and FIG. 8C may also be implemented with reference to the embodiment of FIG. 4B.

The enabling period MEPa (corresponding to the first display period) in which the first pixel voltage VP1 corresponding to the grey-level MGL is applied to the turned on pixel P as shown in FIG. 8A, the enabling period MEPb (corresponding to the third display period) in which the first pixel voltage VP1 corresponding to the grey-level MGL is applied to the turned on pixel P as shown in FIG. 8B, the enabling period MEPc (corresponding to the third display period) in which the first pixel voltage VP1 corresponding to the grey-level MGL is applied to the turned on pixel P as shown in FIG. 8C, and the enabling period MEPd (corresponding to the third display period) in which the first pixel voltage VP1 corresponding to the grey-level MGL is applied to the turned on pixel P as shown in FIG. 8D are alternately arranged with each other, such that the lighting time periods of the pixels in the (4n+1)-th, (4n+2)-th, (4n+3)-th and (4n+4)-th rows are arranged alternately with each other, or the lighting time periods of the pixels in the (4n+1)-th, (4n+2)-th, (4n+3)-th and (4n+4)-th columns are arranged alternately with each other. For example, the time points at which curves 410*a*, 410*b*, 410*c* and 410*d* reach the optical effect OE1 are alternately arranged with each other. During the enabling periods SEP1*a*, SEP2*a*, SEP3*a* (corresponding to the second display period), SEP1*b*, SEP2*b*, SEP3*b*, SEP1*c*, SEP2*c*, SEP3*c*, SEP1*d*, SEP2*d*, SEP3*d* (corresponding to the fourth display period), the second pixel voltage VP2 corresponding to the grey-level SGL1, SGL2 or SGL3 is applied to the turned on pixel P. Therefore, the present embodiment reduces the feeling of frame flicker while improving the color washout phenomenon.

Figure 9:
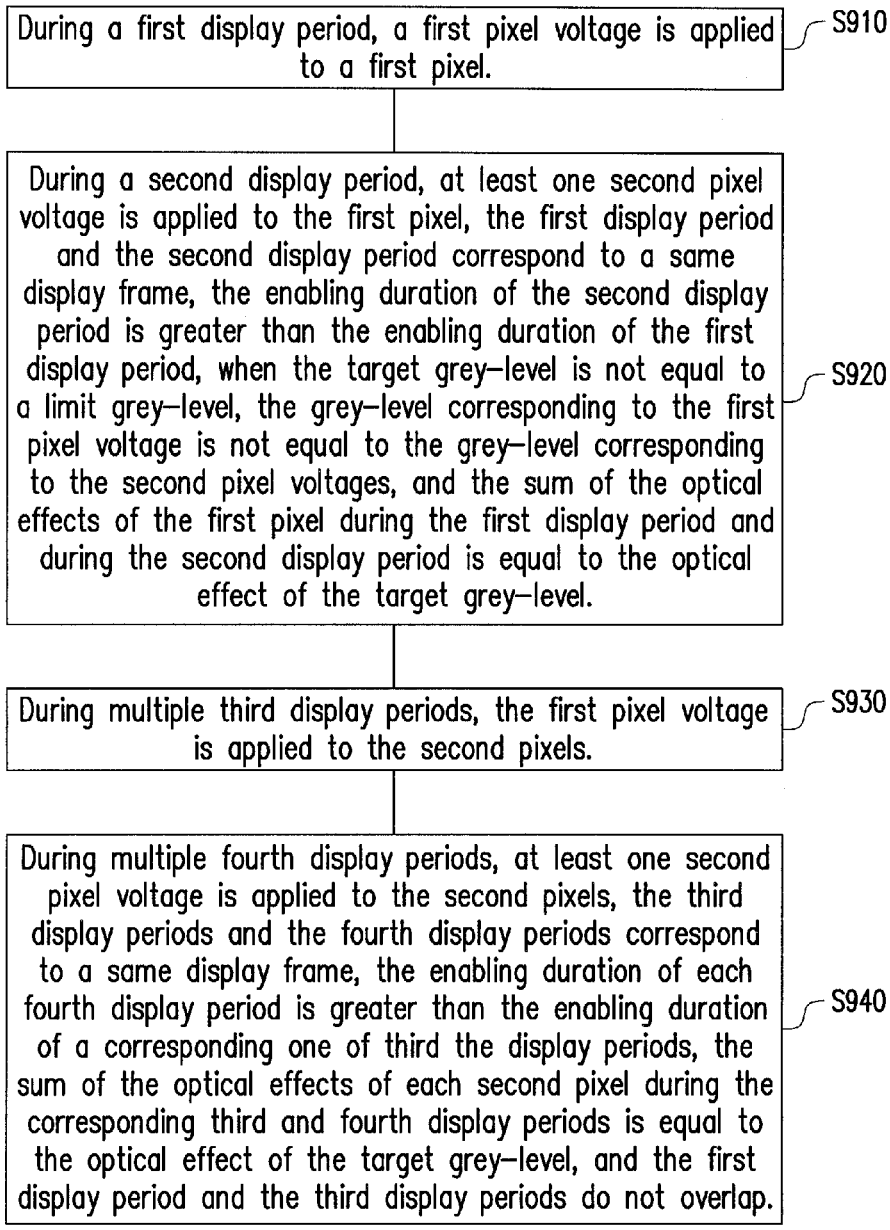
FIG. 9 illustrates a flow chart of a driving method of pixels of a display panel according to one embodiment of the present disclosure.

FIG. 9 illustrates a flow chart of a pixel driving method for a display panel according to one embodiment of the present disclosure. Referring to FIG. 9, during a first display period, a first pixel voltage is applied to a first pixel (step S910). During a second display period, at least one second pixel voltage is applied to the first pixel (step S920), wherein the first display period and the second display period correspond to a same display frame, and the enabling duration of the second display period is longer than the enabling duration of the first display period. Moreover, when the target grey-level is not equal to a limit grey-level, the grey-level corresponding to the first pixel voltage is not equal to the grey-levels corresponding to the second pixel voltages, and the sum of the optical effects of the first pixel during the first display period and the during the second display period is equal to the optical effect of the target grey-level. During multiple third display periods, the first pixel voltage is applied to the second pixels (step S930). During multiple fourth display periods, at least one second pixel voltage is applied to the second pixels (step S940), wherein the third display periods and the fourth display periods correspond to a same display frame, and The enabling duration of each fourth display period is longer than the enabling duration of a corresponding one of the third display periods, the sum of the optical effects of each second pixel during the corresponding third and fourth display periods is equal to the optical effect of the target grey-level, and the first display period and the third display periods do not overlap. The order of the above steps is described for the purposes of illustration only and should not be regarded as limiting. In addition, for details of the above steps, the description of the embodiments of FIG. 6A, FIG. 6B, FIGS. 7A to 7C, FIGS. 8A to 8D may be referred to, and explanation thereof is not repeated herein.

In summary, in the driving method of the pixels of the display panel of embodiments of the present disclosure, when the target grey-level of the display frame is not equal to the limit grey-level, the grey-level that the first pixel voltage applied to the pixel during the first display period corresponds to is set to be different from the grey-level that the second pixel voltage applied to the pixel during the second display period corresponds to, and the sum of the optical effects the pixel provides during the first display period and during the second display period is equal to the optical effect of the target grey-level. As such, there is a difference between the optical effects the pixel provides during the first display period and during the second display period, thereby improving the color washout phenomenon without sacrificing the aperture ratio of the pixel. In addition, the pixels of the display panel can be divided into multiple parts and the lighting time periods of these parts of pixels are separated to reduce the feeling of frame flicker.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A driving method of pixels of a display panel, adapted to drive a first pixel of the display panel corresponding to a target grey-level of a display frame, and adapted to drive multiple second pixels of the display panel corresponding to the target grey-level of the display frame, the pixel driving method comprising:

applying a first pixel voltage to the first pixel during a first display period;

applying at least one second pixel voltage to the first pixel during a second display period;

applying the first pixel voltage to the second pixels during multiple third display periods, respectively; and applying at least one second pixel voltage to the second pixels during multiple fourth display periods, wherein, the first display period and the second display period correspond the display frame, an enabling duration of the second display period is longer than the enabling duration of the first display period, when the target grey-level is not equal to a limit grey-level, the grey-level corresponding to the first pixel voltage is different from the grey-levels correspond to the second pixel voltages, and a sum of optical effects the first pixel provides during the first display period and during the second display period is equal to the optical effect of the target grey-level, wherein, the third display periods and the fourth display periods correspond to the display frame, the enabling duration of each of the fourth display periods is longer than the enabling duration of a corresponding one of the third display periods, a sum of the optical effects of each of the second pixels during each corresponding third display period and fourth display period is equal to the optical effect of the target grey-level, and the first display period and the third display periods do not overlap.

2. The driving method according to claim 1, wherein the first display period is prior to the second display period.

3. The driving method according to claim 1, wherein the first display period comprises a first enabling period, the first pixel voltage is applied to the first pixel during the first enabling period, the second display period comprises at least one second enabling period, and the second pixel voltages are respectively applied to the first pixel during the second enabling periods.

4. The driving method according to claim 3, wherein the first enabling period and the second enabling periods are equal to each other.

5. The driving method according to claim 1, wherein the grey-levels corresponding to the second pixel voltages are different from each other.

6. The driving method according to claim 5, wherein the grey-levels corresponding to the second pixel voltages are arranged in an order from high level to low level according to a time sequence.

7. The driving method according to claim 1, wherein the grey-levels corresponding to the second pixel voltages are equal to each other.

8. The driving method according to claim 1, wherein the grey-level corresponding to the first pixel voltage is larger than the grey-levels corresponding to the second pixel voltages.

9. The driving method according to claim 8, wherein the grey-level corresponding to the first pixel voltage is larger than the target grey-level, and the grey-levels corresponding to the second pixel voltages are less than the target grey-level.

10. The driving method according to claim 1, wherein when the target grey-level is equal to a limit grey-level, the grey-levels corresponding to the first pixel voltage and the second pixel voltages are set to be equal to the target grey-level.

11. The driving method according to claim 1, wherein the first display period and the third display periods are alternately arranged.

12. The driving method according to claim 1, wherein each of the third display periods is prior to a corresponding one of the fourth display periods.

13. The driving method according to claim 1, wherein each of the third display periods comprises a first enabling period, the first pixel voltage is applied to a corresponding one of the second pixels during the first enabling period, each of the fourth display period comprises at least one second enabling period, and the second pixel voltages are respectively applied to a corresponding one of the second pixels during the second enabling periods.

14. The driving method according to claim 13, wherein the first enabling period and the second enabling periods are equal to each other.

* * * * *